US009440131B2

(12) United States Patent
Mueller

(10) Patent No.: US 9,440,131 B2
(45) Date of Patent: Sep. 13, 2016

(54) SPORTS TRAINING DEVICE

(71) Applicant: Daniel Jay Mueller, Pewaukee, WI (US)

(72) Inventor: Daniel Jay Mueller, Pewaukee, WI (US)

( * ) Notice: Subject to any disclaimer, the term of this patent is extended or adjusted under 35 U.S.C. 154(b) by 0 days.

(21) Appl. No.: 14/672,192

(22) Filed: Mar. 29, 2015

(65) Prior Publication Data

US 2016/0193516 A1 Jul. 7, 2016

Related U.S. Application Data

(60) Provisional application No. 62/099,201, filed on Jan. 1, 2015.

(51) Int. Cl.
*A63B 23/12* (2006.01)
*A63B 69/00* (2006.01)

(52) U.S. Cl.
CPC .... *A63B 69/0002* (2013.01); *A63B 2069/0004* (2013.01); *A63B 2069/0008* (2013.01); *A63B 2243/0004* (2013.01)

(58) Field of Classification Search
CPC ..... A63B 69/0059; A63B 2069/0008; A63B 2209/10; A63B 2102/18; A63B 60/10
USPC ..... 473/457, 458, 564, 567
See application file for complete search history.

(56) References Cited

U.S. PATENT DOCUMENTS

| | | | | | |
|---|---|---|---|---|---|
| 3,937,465 | A * | 2/1976 | Roland | A63B 69/38 | 473/229 |
| 5,174,575 | A * | 12/1992 | Leith | A63B 69/0059 | 473/213 |
| 5,704,856 | A * | 1/1998 | Morse | A63B 21/0004 | 473/212 |
| 5,865,685 | A * | 2/1999 | Thomas | A63B 69/3608 | 473/213 |
| 6,059,675 | A * | 5/2000 | Finn | A63B 59/50 | 473/457 |
| D444,193 | S * | 6/2001 | Dodson | D21/725 | |
| 6,773,366 | B2 | 8/2004 | Gray | | |
| 6,827,654 | B2 * | 12/2004 | Meyer | A63B 69/0059 | 24/300 |
| 9,242,159 | B1 * | 1/2016 | Lacoste | A63B 69/0002 | |
| 2007/0054758 | A1 | 3/2007 | Cockrell | | |
| 2011/0039640 | A1 * | 2/2011 | Principe | A63B 69/0002 | 473/458 |
| 2013/0324331 | A1 | 12/2013 | Barnhill | | |

* cited by examiner

*Primary Examiner* — Joshua Kennedy
(74) *Attorney, Agent, or Firm* — Ryan Kromholz & Manion, S.C.

(57) ABSTRACT

A device for training a baseball/softball player to swing a bat with a positioning apparatus affixed to the bat and a guide component tethered to an adjustable cuff on the upper arm of the trailing arm. Interconnection of guide component and positioning apparatus prevents the hands and bat from casting away from torso through midpoint in the swing and Prevents barrel of the bat from preceding knob end of the bat prior to the point of contact with ball. Positioning apparatus disengages from guide component prior to point of contact with ball allowing player to complete the swing.

4 Claims, 5 Drawing Sheets

SPORTS TRAINING DEVICE

CROSS REFERENCE TO RELATED APPLICATIONS

This application claims the benefit of U.S. Provisional Application No. 62/099,201 filed Jan. 1, 2015, the contents of which are hereby incorporated by reference.

STATEMENT OF FEDERALLY SPONSORED RESEARCH OR DEVELOPMENT

Not Applicable

REFERENCE TO SEQUENCE LISTING

Not Applicable

BACKGROUND OF THE INVENTION

The present invention relates to the field of sports, and more specifically, training devices used to train baseball/softball players to swing a bat.

It is generally difficult for players to learn how to utilize effective body mechanics to swing a bat. A common mistake is casting the hands and bat away from the torso during the initial phases of the swing. Another common mistake is allowing the barrel of the bat to precede the knob end of the bat prior to the point of contact with the ball. Both of these mistakes result in a long and slow swing which negatively impacts batting performance.

Teaching batters to use effective body mechanics is a difficult task. A preferred method is to have the player experience what it feels like to swing the bat correctly. One means of accomplishing this is to have someone with expertise stand nearby and physically manipulate the player's body through the process of swinging the bat; however, this method is awkward and generally ineffective. An alternative preferred means is to utilize a training device that guides the player through the swing.

Publication US20070054758 to Cockrell discloses a baseball batting training appliance with a strap that interconnects the leading wrist with a waist belt. The purpose of the apparatus is to teach coordinated movement of the player's hands, hips and upper body. Unlike the present invention, the appliance has no means of preventing the hands and bat from casting away from the torso during the initial phases of the swing. Unlike the present invention, the appliance has no means of preventing the barrel of the bat from preceding the knob end of the bat prior to the point of contact with the ball.

Publication US20130324331 to Barnhill discloses a swing aid device with a strap that interconnects a planar base to the upper area of the trailing arm. The purpose of the device is to prevent the trailing arm from extending away from the torso during the process of a swing. Unlike the present invention, the device has no means of preventing the hands and bat from casting away from the torso during the initial phases of the swing. Unlike the present invention, the device has no means of preventing the barrel of the bat from preceding the knob end of the bat during the initial phases of the swing prior to the point of contact with the ball.

U.S. Pat. No. 6,773,366 to Gray discloses an apparatus for developing a more rapid baseball swing with a strap that interconnects the leading elbow with the trailing wrist. The purpose of the apparatus is to prevent the hands and bat from casting away from the torso during the swing. The apparatus, however, is unable to prevent the player's trailing elbow from straightening at the start of the swing, and when the player straightens the trailing elbow, the apparatus is rendered ineffective as the hands and bat are likely to cast away from the torso. The present invention does not exhibit this vulnerability. The function of the present invention is dissimilar and is a more effective means of ensuring the player's hands and bat do not cast away from the torso. The present invention is also a more effective means of preventing the barrel of the bat from preceding the knob end of the bat prior to the point of contact with the ball.

U.S. Pat. No. 5,704,856 to Morse discloses a batter's training device with an elastic strap that interconnects the leading wrist and the leading leg. The purpose of the device is to teach shifting body weight from the rear leg to the leading leg during the swing. The function and object of the apparatus is dissimilar to the present invention.

BRIEF SUMMARY OF THE INVENTION

The present invention is a training device providing a means of teaching a baseball player to avoid several common errors when swinging a bat. The device is comprised of a positioning apparatus that is affixed to the bat and a guide component that is tethered to the upper arm of the trailing arm. The positioning apparatus and guide component are interconnected during the initial phases of the swing thereby preventing the hands and the bat from casting away from the torso and thereby preventing the barrel of the bat from preceding the knob end of the bat prior to the point of contact with the ball. The positioning apparatus disengages from the guide component at midpoint in the swing prior to the point of contact with the ball thereby allowing the player to complete the swing.

BRIEF DESCRIPTION OF SEVERAL VIEWS OF THE DRAWINGS

Non-limiting and non-exhaustive embodiments of the invention are described with reference to the following figures, wherein like reference numerals refer to like parts throughout the various views.

DETAILED DESCRIPTION OF THE INVENTION

Figure 1:
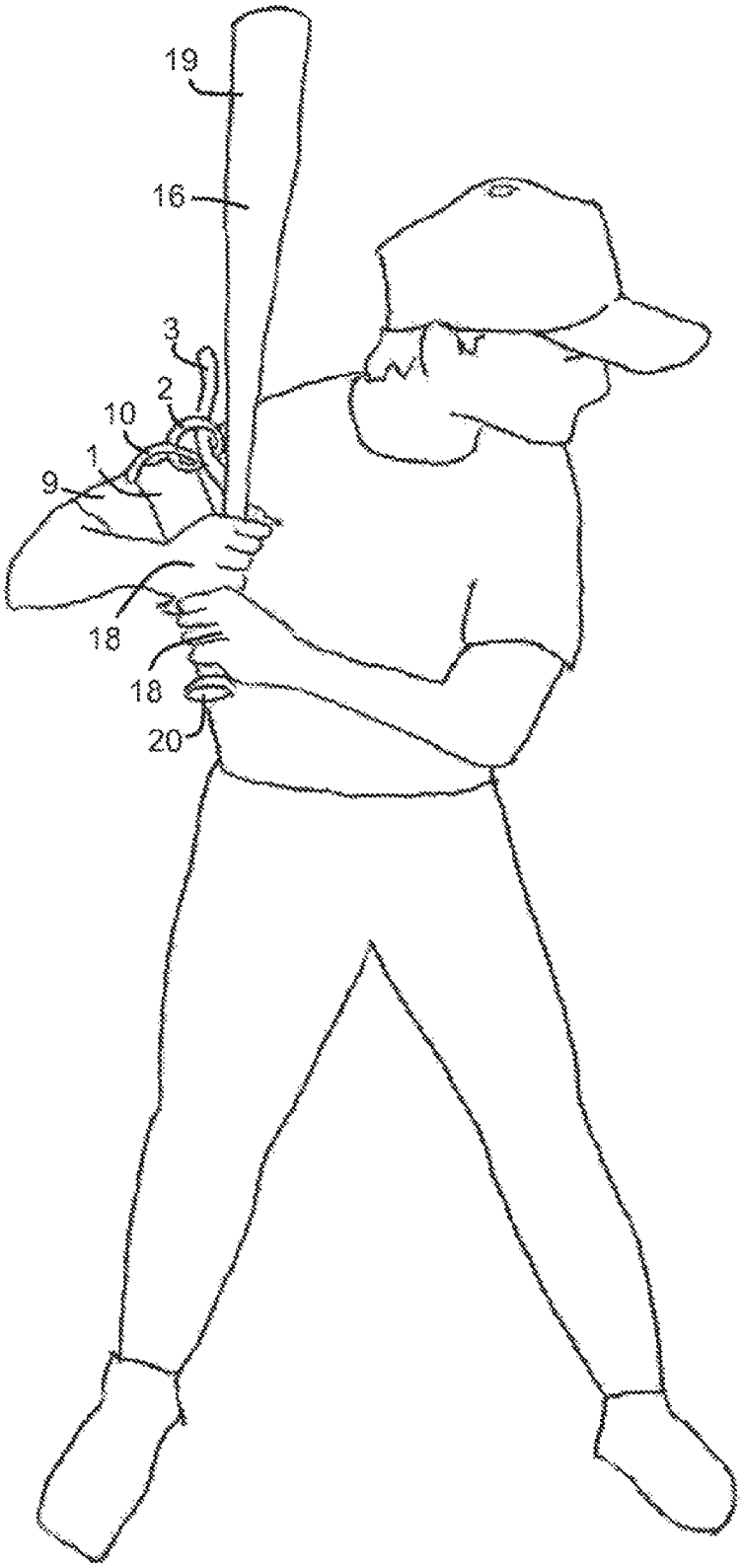
FIG. 1 Provides an illustration of a method of using particular embodiments of the sports training device showing a front view of the player in a standard batting stance prior to the swing.

While the present invention is susceptible of embodiment in various forms, there is shown in the drawings and will hereinafter be described presently preferred embodiments of the invention with the understanding that the present disclosure is to be considered as an exemplification of the invention, and is not intended to limit the invention to the specific embodiments illustrated.

FIGS. 1-5 describe a preferred embodiment of the sports training device. The device includes an adjustable cuff 1, a guide component 2 and a positioning apparatus 3. Adjustable cuff 1 is comprised of nylon strapping with a first end 4 and a second end 5, wherein the second end 5 is threaded through a rectangular metal ring 6 on the first end 4 to form a loop. Corresponding hook 7 and loop 8 surfaces on strapping are connected to secure adjustable cuff 1 to upper arm of trailing arm 9. Guide component 2 is a metal O-ring that is tethered to adjustable cuff 1 by a metal D-ring 10.

Figure 4:
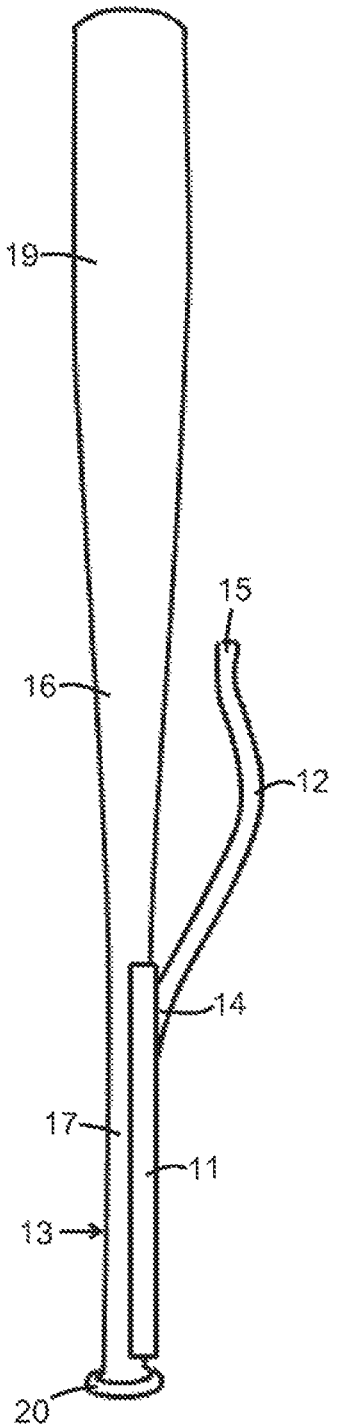
FIG. 4 shows a perspective view of the particular embodiment of the positioning apparatus affixed to the bat.
Figure 5:
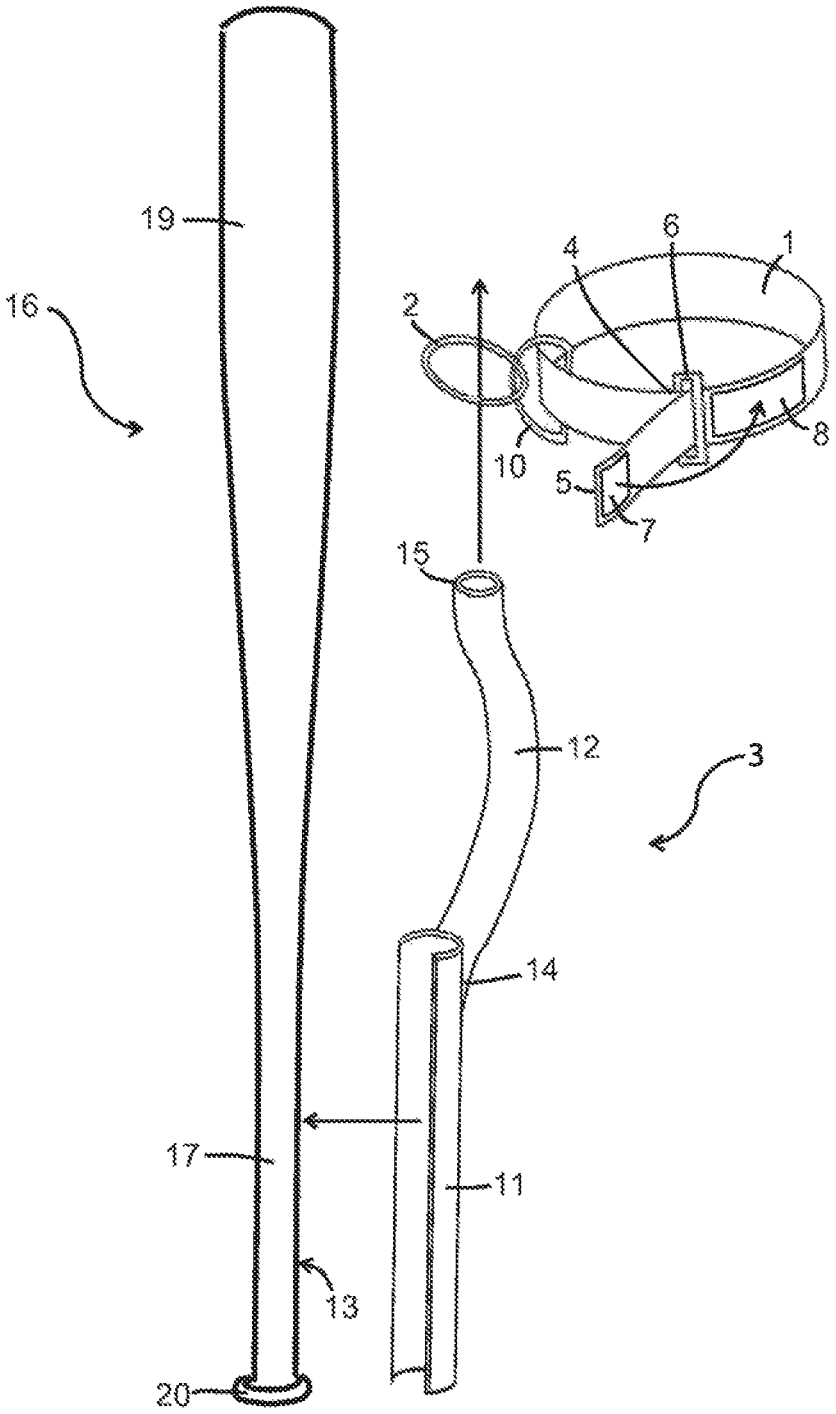
FIG. 5 shows an elevated view of the particular embodiments of the sports training device and the bat.

Now referring primarily to FIGS. 4 and 5, positioning apparatus 3 is comprised of rigid plastic and includes a first section 11 and a second section 12. First section 11 is straight and thin with a surface curvature that aligns with surface of bat handle 13. Second section 12 is circular shaft originating from an end 14 of first section 11 and forming multiple angles as it extends in the direction opposite the first section 11 with its distal end 15 terminating at a point adjacent to the bat 16.

FIG. 4 shows a perspective view of the positioning apparatus 3 in a proper position on bat handle 17.

FIG. 5 shows an elevated view of the particular embodiments of the sports training device and bat 16.

Figure 2:
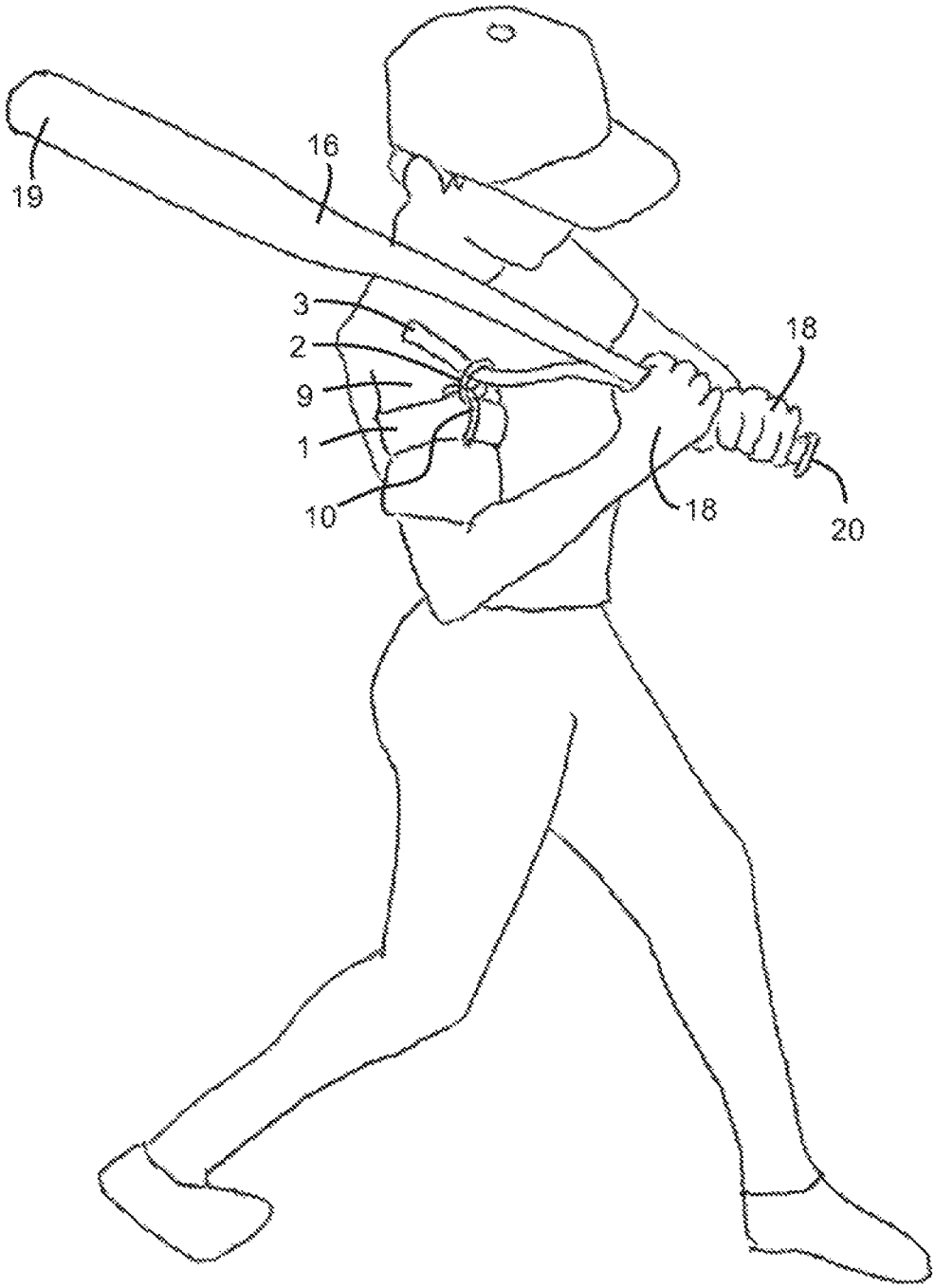
FIG. 2 Provides an illustration of a method of using particular embodiments of the sports training device showing a front view of the player in an initial phase of the swing.
Figure 3:
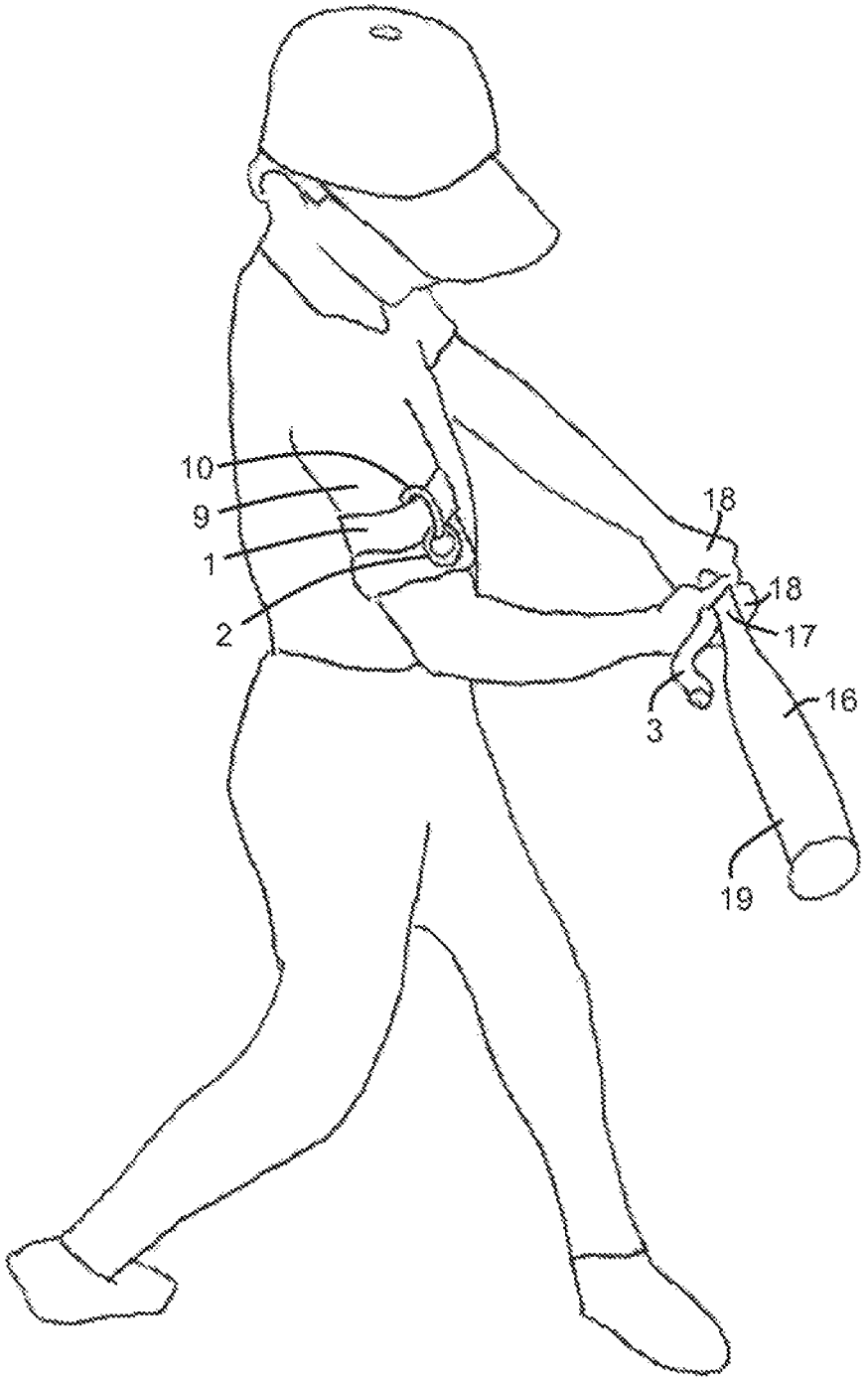
FIG. 3 Provides an illustration of a method of using particular embodiments of the sports training device showing a front view of the player in mid-swing at the approximate point of contact with the ball.

Now referring primarily to FIGS. 1, 2 and 3, a method of using particular embodiment of sports training device is described. Adjustable cuff 1 is secured to upper arm of trailing arm 9 with guide component 2 positioned on front of upper arm of trailing arm 9. Positioning apparatus 3 is aligned parallel with bat 16 and affixed to bat handle 17 through physical force applied by the hands 18. As shown in FIG. 1 positioning apparatus 3 is inserted into guide component 2 prior to swing and player assumes a standard batting stance. As shown in FIG. 2 device guides player during initial phase of swing preventing hands 18 and bat 16 from casting away from torso and preventing barrel of bat 19 from preceding knob of bat 20 prior to point of contact with ball. As shown in FIG. 3 positioning apparatus 3 disengages from guide component 2 prior to point of contact with ball allowing player to complete the swing.

The invention claimed is:

1. A sports training device comprising:

a guide component configured to be carried by a sports participant;

a positioning apparatus configured to be carried by a sports implement, said positioning apparatus comprising a semi-cylindrical sports implement engaging portion and a rigid guide component engaging portion comprising a first end coupled to said sports implement engaging portion to create an angular relationship between said sports implement engaging component and said guide component engaging component, and a second, free end;

said second, free end of guide component engaging portion of said positioning apparatus selectively slidably engaged through said guide component such that the positioning apparatus is configured to be slidably released from engagement with said guide component during a swing of said sports implement;

said second, open end of guide component engaging portion of said positioning apparatus selectively slidably engaged through said guide component.

2. A sports training device according to claim 1, said guide component carried by a cuff configured to be secured to an upper arm portion of a trailing arm of said sports participant.

3. A sports training device comprising:

a ring-shaped guide component configured to be carried by a sports participant;

a rod-shaped positioning apparatus carried by a baseball bat, said positioning apparatus comprising a guide component engaging portion coupled to said baseball bat to create an angular relationship between said baseball bat and said guide component engaging component;

said guide component engaging portion of said positioning apparatus having a free end and being selectively slidably engaged through said ring shaped guide component such that the positioning apparatus is configured to be slidably released from engagement with said guide component during a swing of said sports implement.

4. A baseball bat training apparatus comprising:

a ring structure carried by a cuff configured to be carried by a sports participant;

a knob coupled to a barrel along a bat axis;

a rigid positioning apparatus with a free end, said positioning apparatus carried by and projecting from said baseball bat, said positioning apparatus coupled to said baseball bat defining an acute angular relationship between said bat axis from said barrel, along said bat axis, and said positioning apparatus, said free end of said positioning apparatus selectively slidably coupled through the ring structure such that the positioning apparatus is configured to be slidably released from engagement with said guide component during a swing of said sports implement.

* * * * *